United States Patent [19]

Pool

[11] Patent Number: 4,595,809

[45] Date of Patent: Jun. 17, 1986

[54] SNAP ACTION DOME SWITCH HAVING WIRE CONTACTS

[75] Inventor: L. Franklin Pool, Vancouver, Wash.

[73] Assignee: Dart Industries, Inc., Northbrook, Ill.

[21] Appl. No.: 641,894

[22] Filed: Aug. 17, 1984

[51] Int. Cl.[4] ..... H01H 13/52

[52] U.S. Cl. ..... 200/76; 200/159 B; 200/284

[58] Field of Search ..... 200/76, 159 A, 159 B, 200/284

[56] References Cited

U.S. PATENT DOCUMENTS

| | | | |
|---|---|---|---|
| 3,800,104 | 3/1974 | Lien et al. | 200/159 A |
| 4,005,293 | 1/1977 | Boulanger | 200/159 B |
| 4,032,738 | 6/1977 | Esty et al. . | |
| 4,056,700 | 11/1977 | Stannek . | |
| 4,125,934 | 11/1978 | Keough et al. | 200/159 B |
| 4,207,448 | 6/1980 | Furusawa et al. | 200/159 B |
| 4,439,646 | 3/1984 | Bouvrande | 200/159 B |
| 4,484,042 | 11/1984 | Matsui | 200/159 A |

*Primary Examiner*—Stephen Marcus
*Assistant Examiner*—Renee S. Kidorf
*Attorney, Agent, or Firm*—A. Lewis Worthem, Jr.

[57] ABSTRACT

The present invention is comprised of a dielectric case having defined in it a cylindrical cavity with a larger diameter counterbore in its upper portion. Slots extending across the case and through the cavity have the same depth as the cavity and carry wire conductors whose diameter is less than the difference between the depth of the cavity and the depth of the counterbore. Located medially in the bottom of the cavity is a raised bridge which has a height approximately equal to the amount the diameter of the wire conductors is less than the difference between the depth of the cavity and the depth of the counterbore. Thus the top surfaces of the wires lie below the counterbore proximate the periphery of the cavity and lie approximately co-planar with the lip of the counterbore at the center of the cavity. An electrically conductive deformable dome having a diameter approximately equal to the diameter of the counterbore is secured in the cavity by a piece of transparent tape adhered to the top of the case. The dome provides a noticeable snap immediately before its center becomes co-planar with its periphery when it is deflected and immediately after it returns from being co-planar when released. Thus, the dome comes into contact with the wire conductors, thereby closing the switch, immediately after the snap is felt and breaks contact with the wire conductors to open the switch immediately before the snap is felt.

5 Claims, 3 Drawing Figures

SNAP ACTION DOME SWITCH HAVING WIRE CONTACTS

BACKGROUND OF THE INVENTION

This invention relates to an electric switch and in particular to such a switch which is inexpensively fabricated for use in a throw-away appliance having a limited duty cycle, such as an electrosurgical pencil.

Many appliances of a throw-away nature require switches for activation of the device. While these switches must be reliable and often must be of the type where the user can tell when the switch is opened or closed merely by feel, they will, by the very nature of the device, only be operated a limited number of cycles. Typical of appliances of this type are electrosurgical pencils. These devices have a switch in them which causes current to flow to the pencil from an electrosurgical generator whenever the switch is closed. Since a surgeon will only be making a limited number of cuts in any one operation, and since for sterility reasons the pencil will be discarded after the operation, the switches necessarily will have a limited duty cycle.

However, due to the necessity that the switch be reliable, that it return to its open position when released, that the user can ascertain by feel when it is either opened or closed, rather sophisticated and expensive switches have been used in appliances of this type. While such switches are obviously functionally adequate they raise the cost of the appliance above that which is necessary. While the excess cost associated with using a long duty cycle switch in a throw-away apparatus may not seem significant on a per unit basis, the cumulative effect can be quite significant. This is particularly true in the case of electrosurgical pencils since a large hospital will use a great many of them every year and a relatively small price differential per pencil will result in rather significant differences in overhead costs.

SUMMARY OF THE INVENTION

The present invention overcomes the foregoing shortcomings and limitations of prior art switches by providing a dielectric case having located in it a cylindrical cavity with a larger diameter counterbore at its top. Two slots having the same depth as the cavity extend across the case and through the cavity. The slots are slightly narrower than the diameter of the wire conductors which are carried in them so as to provide a loose press fit therebetween. In addition, the wires have a diameter which is less than the difference between the depth of the cavity and the depth of the counterbore. Thus the top surfaces of the wires are below the counterbore where the wires enter the cavity.

Extending across the center of the cavity is a raised bridge which has a height approximately equal to the amount the diameter of the wires is less than the difference between the depth of the cavity and the depth of the counterbore. Thus the top surfaces of the wires where they pass over the bridge are approximately coplanar with the bottom of the counterbore.

Located in the cavity is an electrically conductive deformable dome which has approximately the same diameter as the counterbore. Since the dome is supported in the counterbore its periphery is above the wires and thus does not make electrical contact with them. However when the center of the dome is deflected to where it is approximately co-planar with its periphery it makes contact with the wires due to their being raised as they pass over the bridge. When this occurs the wires are electrically connected through the dome thereby closing the switch. The tactility of the dome is such that it snaps when its center is deflected to where it becomes co-planar with the periphery of the dome and when it returns from this position. Thus the foregoing dimensional relationship of the dome and the wires is critical in order that the snap is felt immediately prior to the switch being closed and immediately subsequent to the switch being opened.

The dome is held in place in the cavity by a segment of clear tape which is adhered to the top of the case.

Accordingly, it is a principal objective of the present invention to provide a switch for limited duty cycle use which is simple of construction and utilizes inexpensive parts.

It is a further object of the present invention to provide such a switch which creates a detectable snap immediately before it is closed and immediately after it is opened.

It is a still further object of the present invention to provide such a switch which is operably reliable.

The foregoing and other objects, features and advantages of the present invention will be more readily understood upon consideration of the following detailed description taken in conjunction with the accompanying drawings.

DETAILED DESCRIPTION OF THE INVENTION

Figure 1:
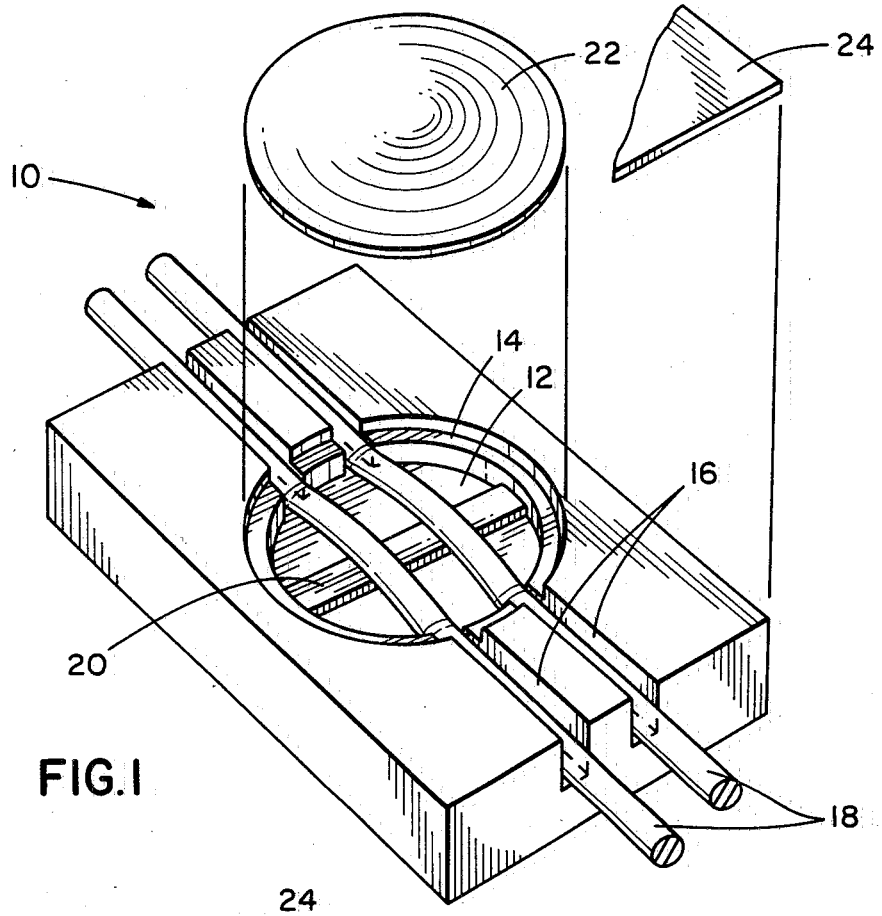
FIG. 1 is an exploded pictorial view showing a switch embodying the features of the present invention.
Figure 2:
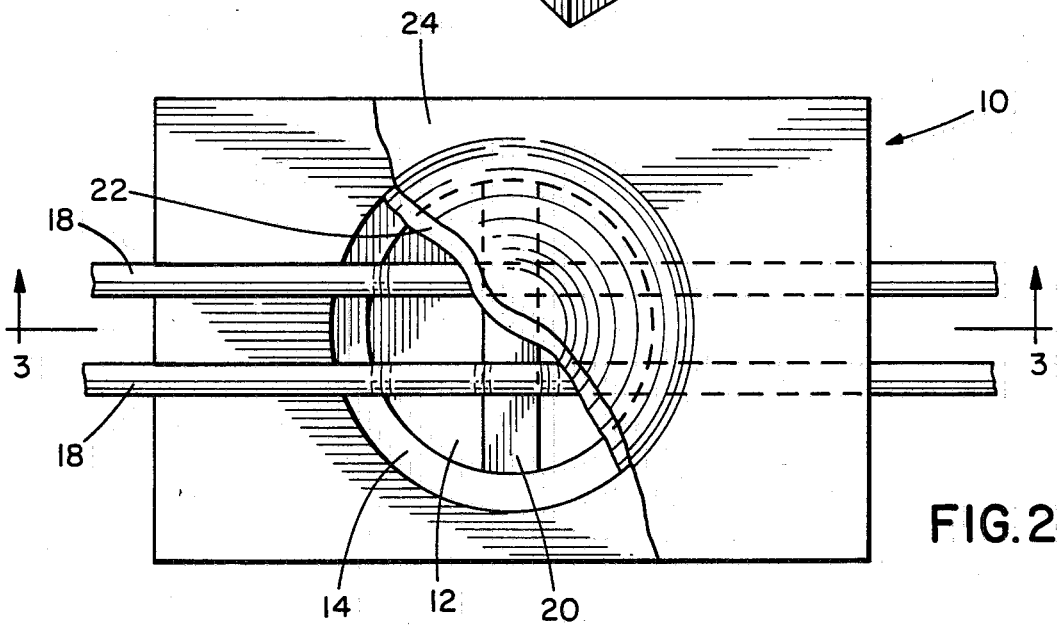
FIG. 2 is a plan view of the switch of FIG. 1, partially broken away to show hidden detail.
Figure 3:
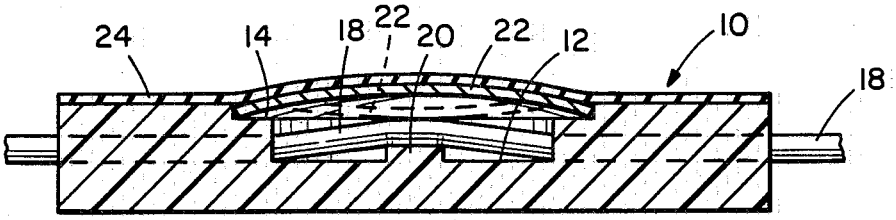
FIG. 3 is a cross-sectional view taken on the line 3—3 in FIG. 2.

Referring to FIG. 1 of the drawings, the present invention comprises a case 10 which is fabricated from a dielectric material. In the embodiment illustrated the case is rectangular and is injection molded plastic. Located medially in the case is a cylindrical cavity 12 which has a larger diameter counterbore 14 located at its upper end. While only one cavity is illustrated, multiple cavities could also be used in applications where it is desired to provide multiple switches in a single case.

Extending across the case and through the cavity are two slots 16 which have the same depth as the cavity. Again while only two slots are shown, more could be used depending on the application of the switch and the number of conductors which are to be activated by it. The slots have a width which is slightly less than the diameter of the wire conductors 18 which are carried in them in order to provide a loose press fit therebetween. The wires 18 in turn have a diameter which is less than the difference between the depth of the cavity 12 and the depth of the counterbore 14. Thus the top surfaces of the wires are below the bottom of the counterbore.

Located in the bottom of the cavity and extending transversely across it is a bridge, in the nature of a raised strip 20 which has a height which is approximately equal to the amount that the wire diameter is less than the difference between the depth of the cavity and the depth of the counterbore. Thus the top surfaces of the wires where they extend over the strip 20 are generally co-planar with the bottom of the counterbore.

An electrically conductive dome 22 having a diameter approximately equal to the diameter of the counterbore is located in the cavity. Retention means, such as a strip of transparent tape 24 secures the dome in place with its periphery resting on the bottom of the counterbore 14. The dome is deformable when deflected by the user's finger and has sufficient tactility that a snap is felt when it is deflected to a position where its center is nearly co-planar with its periphery. The dome is sufficiently resilient that it returns to its relaxed position immediately upon being released, again providing the snap feel when the center of the dome returns from being co-planar with its periphery. Such domes are well known in the prior art and are manufactured and sold by K-B Denver of Fredrich, Colo. under the name "SNAP-DOME." These domes are commonly used as switch elements in printed circuit board applications, such as calculator keyboards.

Unlike printed circuit board switches, the switch of the present invention provides the dimensional control necessary for dome-type switches with inexpensive components which are easily assembled. All that is required is the injected molded plastic case 10, common wire conductors 18, commercially available dome 22 and a segment of transparent tape 24. Assembly is accomplished merely by pressing the wire conductors 18 into the slots 16 and over the bridge 20, assuring that they are bottomed in the slots and have the proper tension so that when they are pressed down over the bridge they are bent to where they are flush with its top surface and then remain in contact with it. The dome 22 is then placed into the counterbore 14 and the tape segments 24 are adhered to the top of the case to hold it in place.

While the direct contact of the dome and the wire conductors does not provide the type of arc free connection that would be condusive to long switch life, it does provide reliability for at least fifty cycles. Thus, in those applications where a switch is required in an appliance which will be discarded after a limited number of cycles, such as an electrosurgical pencil, the present invention provides an operational switch at a much lower price than would be available with prior art switches which are designed for a much higher duty cycle.

The switch is actuated by depressing the dome 22, either directly by the user or by a mechanical actuator (not shown) in the event that the switch is mounted internally in some device. When the dome is deflected to the point where its center is co-planar with its periphery the center contacts the wires 18. Thus, due to its conductivity, it causes the wires to become electrically interconnected thereby closing the switch. When the dome is released, its resiliency causes it to return to its relaxed position to again open the switch.

Since the wires are located in the cavity with their top surfaces below the bottom of the counterbore they do not contact the periphery of the dome. However, when the dome is deflected its center contacts the wires when it is co-planar with its periphery due to the fact that the centers of the wires are raised by the bridge 20. Thus the center of the dome contacts the wires at the same time that its tactility causes it to snap. As a result the user knows that the switch will not become closed until the snap is felt. Likewise once the switch is closed the user knows that it will remain closed until the snap is felt again. As a result the user can tell the status of the switch merely by feel.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A tactilely precise switch comprising:

(a) a case, defining a cylindrical cavity therein, said cavity including a larger diameter counterbore having a lower lip which is located above the bottom of said cavity;

(b) a plurality of conductors;

(c) means associated with said case for press-fit positioning each of said conductors transversely across and through said cavity such that the top surfaces of the conductors are beneath said counterbore proximate the perimeter of said cavity;

(d) bridge means for raising said conductors in the medial portion of said cavity such that the top surfaces thereof are generally co-planar with said lip of said counterbore;

(e) an electrically conductive deformable dome having a diameter which is approximately equal to the diameter of said counterbore; and (f) means for securing said dome in said cavity with its concave side facing said conductors.

2. The switch of claim 1 wherein said means for press-fit positioning said conductors comprises said case defining slots which extend across said case outwardly from substantially diametrically opposite sides of said cavity, said slots having the same depth as said cavity.

3. The switch of claim 2 wherein said cavity has a first depth, said counterbore has a second depth, and said conductors comprise cylindrical wire segments, said wire segments having a diameter which is less than the difference between said first and second depths.

4. The switch of claim 3 wherein said bridge means comprises a raised strip located in the bottom of said cavity, said strip having a height which is approximately equal to the amount that the diameter of said wire segments is less than the difference between said first and second depths.

5. The switch of claim 4 wherein said dome has sufficient tactility that it snaps when the center thereof is deflected to where it is approximately co-planar with its periphery.

* * * * *